US006938828B2

(12) United States Patent
Waalders et al.

(10) Patent No.: US 6,938,828 B2
(45) Date of Patent: Sep. 6, 2005

(54) APPARATUS AND METHOD FOR COMBINED GENERATION OF HEAT AND ELECTRICITY

(75) Inventors: Erwin Johannes Maria Waalders, Lichtenvoorde (NL); Ronald Hubertus Theodorus Maria Hezemans, Silvorde (NL); Michel Martinus Willen Van Wezel, Terborg (NL); Cornelis Aplhonsus Waltherus Baijens, Westervoort (NL); Jozef Johannes Maria Luttikholt, Eibergen (NL); Gerardus Jacobus Josephine Beckers, Sint Maarten (NL)

(73) Assignee: Enatec Micro-Cogen B.V., Lichtenvoorde (NL)

( * ) Notice: Subject to any disclaimer, the term of this patent is extended or adjusted under 35 U.S.C. 154(b) by 0 days.

(21) Appl. No.: 10/296,577

(22) PCT Filed: May 23, 2001

(86) PCT No.: PCT/NL01/00399

§ 371 (c)(1),
(2), (4) Date: Jul. 9, 2003

(87) PCT Pub. No.: WO01/90656

PCT Pub. Date: Nov. 29, 2001

(65) Prior Publication Data

US 2004/0031859 A1 Feb. 19, 2004

(30) Foreign Application Priority Data

May 26, 2000 (NL) ..... 1015319

(51) Int. Cl.[7] ..... F24H 3/00

(52) U.S. Cl. ..... 237/70; 237/12.1; 60/39

(58) Field of Search ..... 237/12.1, 2 A; 60/39.01, 793, 624

(56) References Cited

U.S. PATENT DOCUMENTS 4,295,606 A * 10/1981 Swenson ..... 237/12.1
4,607,169 A * 8/1986 Donnelly, Jr. ..... 290/54
4,873,840 A * 10/1989 Gilliusson ..... 62/238.6
6,525,431 B1 * 2/2003 Clucas et al. ..... 290/2

* cited by examiner

*Primary Examiner*—Derek S. Boles
(74) *Attorney, Agent, or Firm*—Christensen O'Connor Johnson Kindness PLLC

(57) ABSTRACT

The present invention relates to an apparatus for heating fluid in a pipe system, comprising: a first burner for heating pipes of the fluid circuit; a feed for air and/or fuel for causing combustion of this mixture by the burner; a second burner for heating a head of a generator for generating electrical energy; and an outlet pipe for discharging flue gases from the second burner into the space where the first burner is situated.

17 Claims, 2 Drawing Sheets

APPARATUS AND METHOD FOR COMBINED GENERATION OF HEAT AND ELECTRICITY

Due to the liberalizing of electricity supply in Europe, it will certainly become attractive in the future to generate electricity locally in a home as well as heat. If an excess of electricity is generated, this electricity can be supplied to the public grid, thereby decreasing the electricity bill of the user. Transport losses are reduced considerably due to decentralized generation of electricity.

PCT/NZ99/00017 relates to a burner and a Stirling engine for generating electrical energy. The engine is herein arranged in the liquid tank to enable discharge of heat.

The European patent application BP 0 528 109 proposes feeding the exhaust gases of a diesel generator to the combustion chamber of a burner for heating water.

Known from the European patent application 0 455 510 and the British patent GB 2 174 799 is the coupling of a Stirling engine into a domestic circuit. This relates to a hinged deflecting plate for screening the head of the Stirling engine in relation to the burner.

The American patent U.S. Pat. No. 4,534,319 describes a wood-burning stove with heat exchanger for heating water. This also includes electric resistance coils to prevent water from freezing.

The present invention provides an apparatus for heating fluid in a pipe system, comprising;

a first burner for heating pipes of the fluid circuit;

a second burner for heating a head of a generator for the purpose of generating electrical energy;

at least one fe d for air and/or fuel for causing combustion of this mixture by the burners; and an outlet pipe for discharging flue gases from the second burner into the space where the first burner is situated.

In an apparatus according to the present invention the heat from the second burner is used both to generate electricity using the generator and to heat fluid in the pipes. Both burners preferably take a modulating form. The first burner is preferably provided with a choke valve so that it can supply the heat demand, which depends for instance on outside temperatures, thermostat settings and the like.

Electricity is preferably generated with a so-called Stirling generator which is of compact dimensions and has proven itself in practice, for instance in space travel applications.

Such a Stirling generator has to be adapted to the frequency of the electricity grid, which is for instance 50 or 60 Hz, and will thus cause an (audible) vibration which is undesirable. The Stirling generator is preferably suspended resiliently from cables so as to prevent this undesired effect.

Figure 1:
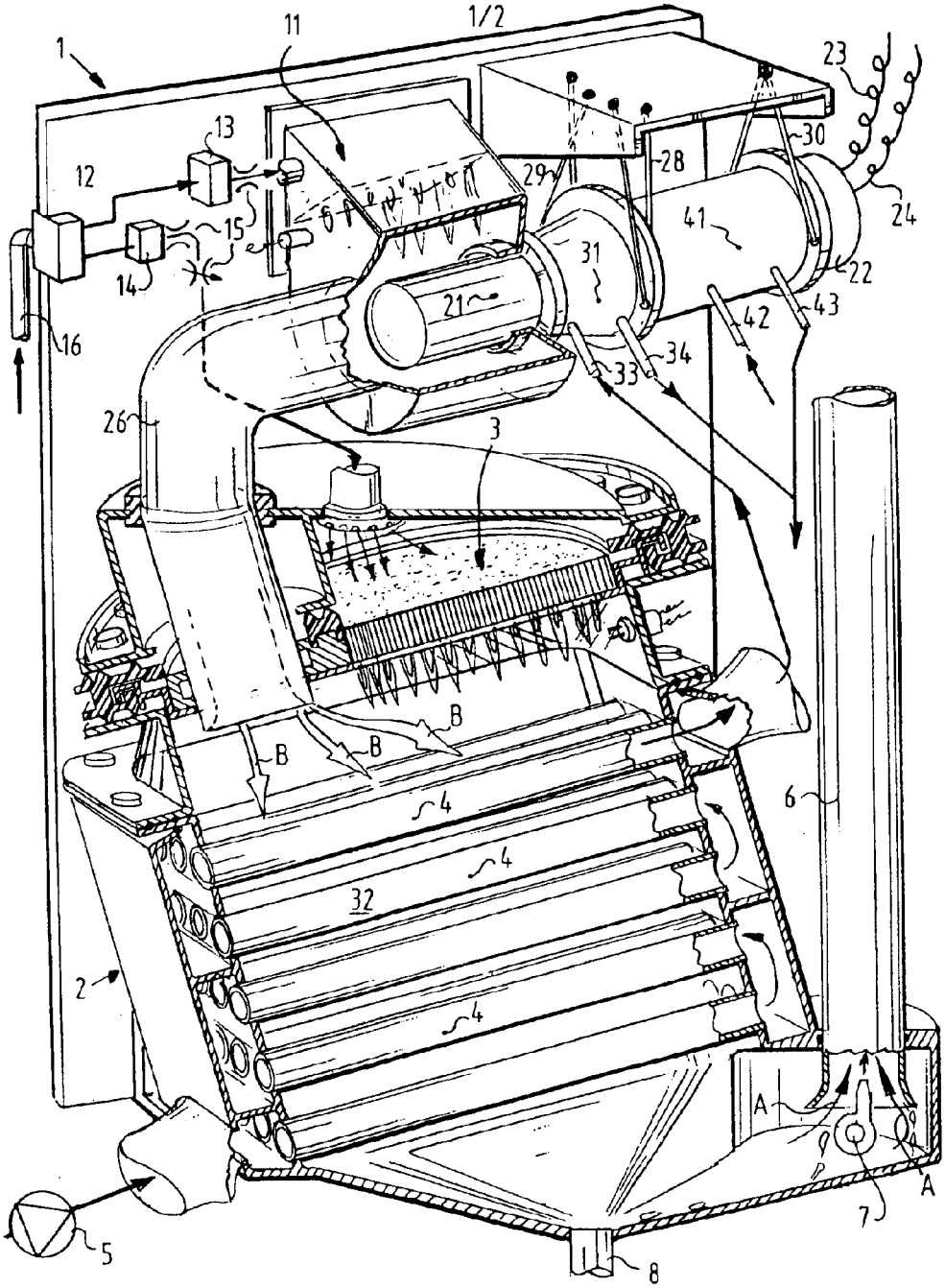
Figure 2:
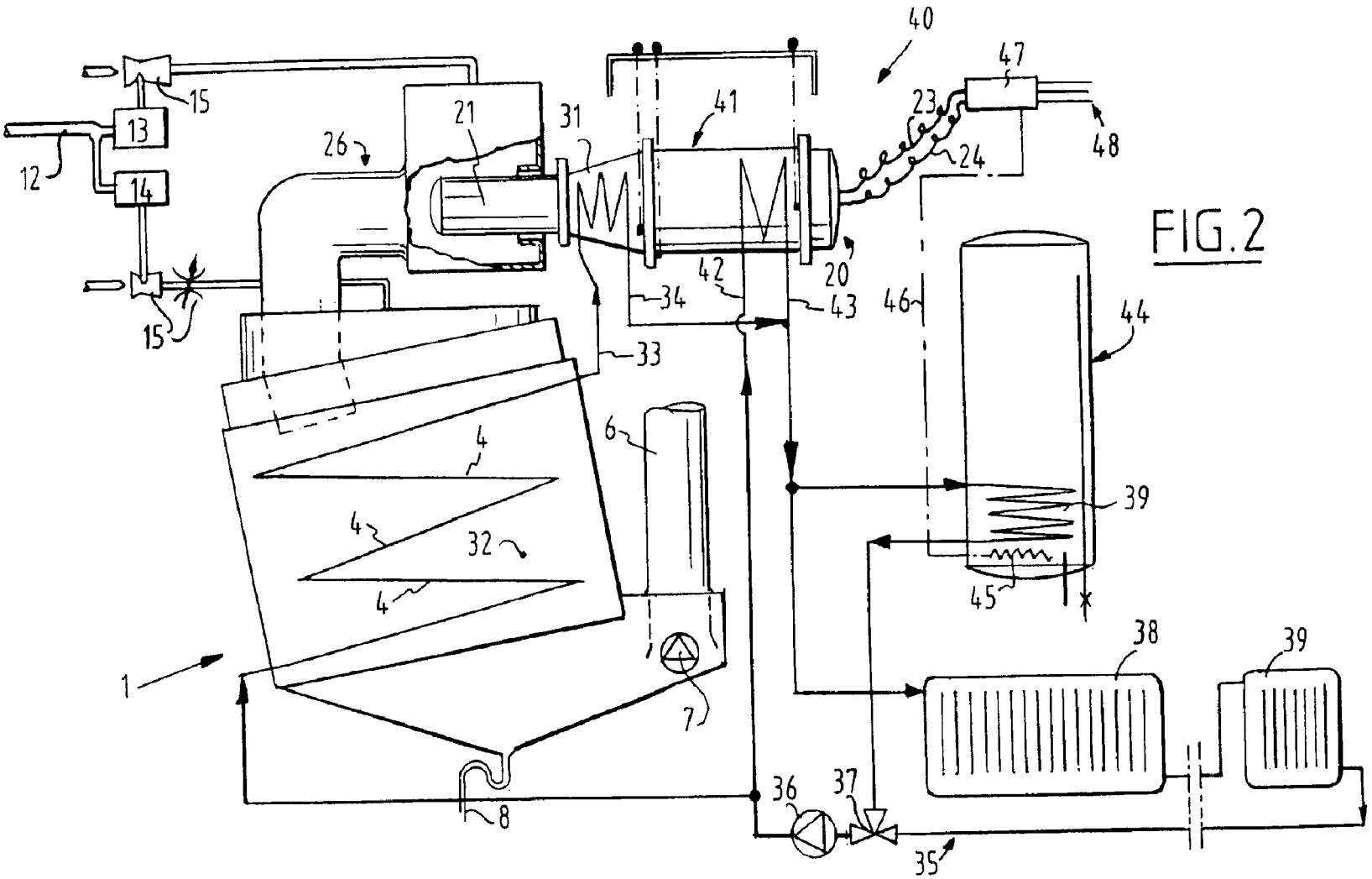

Further advantages, features and details of the present invention will be elucidated on the basis of the following description with reference to the annexed drawings, in which:

FIG. 1 shows a partly cut-away, schematic view of a first preferred embodiment of an apparatus according to the present invention; and FIG. 2 shows a diagram of an installation incorporating the apparatus of FIG. 1.

FIGS. 1 and 2 illustrate an embodiment of an apparatus 1 for generating both heat and power. Power is generated in the form of electricity. The apparatus 1 comprise a heating part 2 that includes a peak burner 3 placed on the head side to heat pipes 4 through which water flows. The heated water can be used for space heating and/or to heat a boiler. For this purpose, the water is circulated by a schematically illustrated pump 5. Flue gases coming from the burner flow along pipes 4 in a downward direction. The flue gas flow is deflected as shown by arrows A into an outlet pipe 6. In the present embodiment, a fan 7 is included to discharge the flue gases into the outlet pipe 6. The apparatus is further provided on the underside with a condensation drain 8.

The construction shown in FIG. 1 and described above corresponds in considerable part with an apparatus currently marketed by the firm Atag Heating under the brand name "Blauwe Engel (Blue Angel) II".

An apparatus formed according to the present invention also includes a second burner 11. The second burner, as shown schematically in FIG. 1, is connected to a gas feed line 16 shared with burner 3. The sharing is controlled by schematically illustrated control valves 12, 13 and 14 and schematically illustrated control or choke valves 15. The gas feed line 16 supplies fuel, such as natural gas.

Burner 11 heats a head 21 of a Stirling generator 20 by generating electricity via lines 23, 24. Such a Stirling generator is known per se and described for instance in older American patents. More specifically, the flue gases coming from burner 11 are forced past and heat the head 21. After passing the head 21, the flue gases are guided by a pipe 26, as shown by arrows B, into the space under burner 3. As a result, the flue gases coming from burner 11 also heat the water in pipes 4 t at least some extent and are discharged via outlet pipe 6.

Heating of the head 21 of Stirling generator 20 causes an alternating current of the desired frequency to be generated by a generator part 22. Since the Stirling generator will cause an (audible) vibration, preferably the Stirling generator is suspended by wires 28, 29 and 30. Tests have shown that such suspension prevents the Stirling generator vibrations from being transferred to and being increased by a mounting plate and/or the housing.

As also shown, particularly in the diagram of FIG. 2 of an installation 40 incorporating the apparatus 1, the head 21 of the Stirling generator 20 is cooled by means of a heat exchanger 31. The heat exchanger 31 is connected in series behind the heat exchanger 32 formed by the pipes 4. Temperature differences are thus reduced, resulting in the efficiency of Stirling generator 20 and sufficient cooling being ensured.

As has been found, the system efficiency is maximal if the coldest fluid is used for cooling the flue gases, which is achieved by the above mentioned series connection. The connections 33 and 34 fed with partly fluid from heat exchanger 32, of heat exchanger 31 are likewise arranged in visible manner in FIG. 1.

Further forming part of cooling circuit 35 are a pump 36, a three-way valve 37, radiators 38 and a heat exchanger 39 for a boiler such as are connected in practice for heating of houses (and on commercial premises). A middle part 41 of Stirling engine 20 is likewise connected to the circuit 35 via connections 42 and 43 in order to also avoid a (too) high temperature of this middle part.

In the preferred embodiment, a so-called electrical dump resistance 45 which is arranged in a boiler 44. The electrical dump resistance is connected by a line 46 to a grid circuit 47. The grid circuit 47 provides a connection between the lines 23, 24 of the Stirling generator 20 and the schematically illustrated electrical grid 48. Should the Stirling engine 20 produce electrical energy which cannot be delivered to the grid, this energy can be supplied to the resistance 45 for heating the water in the boiler.

In a further embodiment (not shown) an energy-dissipating element can also be arranged outside the boiler.

The present invention is not limited to the above described preferred embodiment thereof; the rights sought are defined by the following claims, within the scope of which many modifications can be envisaged.

What is claimed is:

1. Apparatus for heating fluid in a pipe system and generating electrical energy, comprising:

a fluid circuit including pipes;

a first burner for heating the pipes of the fluid circuit;

a feed coupled to the first burner for feeding a mixture of air and fuel to the first burner for causing combustion of this mixture by the first burner;

a generator including a head for generating electrical energy;

a second burner for heating the head of the generator for causing said head of the generator to generate electrical energy; and an outlet pipe or discharging flue gases from the second burner into the space where the first burner is situated.

2. Apparatus as claimed in claim 1, including a choke valve located in the feed coupled to the first burner.

3. Apparatus as claimed in claim 1, including a boiler assembly, the boiler assembly including a heat exchanger connected to the fluid circuit.

4. Apparatus as claimed in claim 3, including an electrical resistance connected to the generator and located in the boiler.

5. Apparatus as claimed in claim 1 wherein the generator also includes a cooling circuit connected to the fluid circuit.

6. Apparatus as claimed in claim 5 wherein the cooling circuit is connected in series with and behind the fluid circuit of the first burner.

7. Apparatus as claimed in claim 1 wherein the generator comprises a Stirling engine.

8. Apparatus as claimed in claim 1 or 7 wherein the generator is suspended resiliently.

9. Apparatus as claimed in claim 8 wherein the generator is suspended from cables.

10. Apparatus as claimed in claim 8, including a boiler assembly, the boiler assembly including a heat exchanger connected to the fluid circuit.

11. Apparatus as claimed in claim 10, including an electrical resistance connected to the generator and located in the boiler.

12. A method for heating fluid and generating electrical energy comprising:

feeding an air and fuel mixture to a first burner through a feed for causing combustion of the mixture by the first burner;

heating the pipes of a fluid circuit by the first burner;

heating the head of a generator that generates electrical energy by a second burner; and discharging flue gases from the second burner through an outlet pipe into the space where the first burner is situated.

13. A method according to claim 12 wherein the air and fuel mixture is supplied to the first burner via a choke valve that controls the supply of heat based on outside temperatures, thermostat settings and the like.

14. A method according to claim 12 wherein the first burner and the second burner are modulated.

15. A method according to claim 12 wherein the generator includes a cooling circuit connected to the fluid circuit.

16. A method according to claim 15 wherein the air and fuel mixture is supplied to the first burner via a choke valve that controls the supply of heat based on outside temperatures, thermostat settings and the like.

17. A method according to claim 12 or 15 wherein the generator is cooled close to the head of the generator by fluid flowing out of a heat exchanger heated by the first burner.

* * * * *